US008291544B2

(12) United States Patent
Chen et al.

(10) Patent No.: US 8,291,544 B2
(45) Date of Patent: Oct. 23, 2012

(54) MOP WITH THE FUNCTION OF DEWATERING THE YARNS BY TWISTING IN A SINGLE DIRECTION VIA AN UP-AND-DOWN LINEAR MOTION

(75) Inventors: Yung-Hua Chen, Lujhou (TW); Chin-Yang Shin, Gueishan Township, Taoyuan County (TW)

(73) Assignee: Tuo Shen International Corporation Limited, Taoyuan County (TW)

( * ) Notice: Subject to any disclaimer, the term of this patent is extended or adjusted under 35 U.S.C. 154(b) by 627 days.

(21) Appl. No.: 12/458,130

(22) Filed: Jul. 1, 2009

(65) Prior Publication Data

US 2011/0000044 A1 Jan. 6, 2011

(51) Int. Cl.
*A47L 13/58* (2006.01)

(52) U.S. Cl. ..... 15/260; 15/229.1

(58) Field of Classification Search ..... 15/229.1, 15/260

See application file for complete search history.

(56) References Cited

U.S. PATENT DOCUMENTS 8,056,179 B2 * 11/2011 Hsu ..... 15/260

* cited by examiner

*Primary Examiner* — Randall Chin
(74) *Attorney, Agent, or Firm* — Rosenberg, Klein & Lee

(57) ABSTRACT

A mop with the function of dewatering the yarns by twisting in a single direction via an up-and-down linear motion, comprising: a) an internal rod; b) an external rod having a bottom portion in a telescopic connection with a top portion of the internal rod; c) an engaging element positioned within the opening at the top of the internal rod; d) a driving element formed in an elongated shape and positioned within the external rod in such a way that the driving element is moved up and down synchronically with the external rod; e) an actuating element positioned within the engaging element for accommodating the driving element, the engaging element being driven in a single direction when the actuating element is rotated by the driving element; f) a disc body secured to the bottom thereof and having mop yarns; g) a locking mechanism mounted on the external rod for locking the internal rod and the external rod in place or for unlocking them in a telescopic state, wherein the actuating element is rotated by a linear motion of the driving element when the external rod is moved up-and-down.

6 Claims, 8 Drawing Sheets

MOP WITH THE FUNCTION OF DEWATERING THE YARNS BY TWISTING IN A SINGLE DIRECTION VIA AN UP-AND-DOWN LINEAR MOTION

BACKGROUND OF THE INVENTION

1. Field of the Invention

The invention relates to a mop with the function of dewatering the yarns by twisting in a single direction via an up-and-down linear motion, and more particularly to a structure that ensures an ergonomic operation such that the mop yarns can be dewatered in a more convenient and safe manner.

2. Description of the Related Art

After a mop has been used, it is necessary to wring dirty water from mop fabrics (or cotton strips) of the mop before soaking the mop in clean water again to facilitate washing a floor, and mopping is obviously a tiresome job. Therefore, related manufacturers have developed various different dewatering devices for the mop, such as a dewatering device disclosed in R.O.C. Pat. No. 347146, wherein a pedal is provided for driving a gear to rotate a dewatering tank at a fast speed, so as to wring cotton strips of the mop placed in the dewatering tank. Although the aforementioned device can improve the inconvenient way of wringing the mop fabrics by hand, yet the operation still requires a user to step on the pedal continuously by one foot, and keep the user's body in balance by another foot. Such arrangement not only involves an inconvenient operation, but also endangers the safety of users when the users fail to stand stably or fall. Therefore, it is necessary to develop a mop with an easy, convenient and safe operation in dewatering.

SUMMARY OF THE INVENTION

An object of the invention is to provide a mop with the function of dewatering the yarns by twisting in a single direction via an up-and-down linear motion wherein the operation only requires the operator's hand holding on the mop handle to conduct an up-and-down motion for a practical rotation of the disc body at the bottom thereof. Thus, the water attached to the mop yarns may be thrown away in an ergonomic and convenient way.

Another object of the invention is to provide a mop with the function of dewatering the yarns by twisting in a single direction via an up-and-down linear motion that permits a safer use since the operation requires only the operator's hand without the trampling action with feet.

A further object of the invention is to provide a mop with the function of dewatering the yarns by twisting in a single direction via an up-and-down linear motion wherein a driving mechanism within the bucket body is not required for the rotation of the dewatering basket. As a result, the cost can be reduced. Moreover, the mechanism may be simplified and the failure rate can be decreased, too. Therefore, the service life of the product may be prolonged.

In order to achieve the above-mentioned objects, the mop with the function of dewatering the yarns by twisting in a single direction via an up-and-down linear motion in accordance with the invention includes:

a) an internal rod;

b) an external rod having a bottom portion in a telescopic connection with a top portion of the internal rod;

c) an engaging element positioned within the opening at the top of the internal rod;

d) a driving element formed in an elongated shape and positioned within the external rod in such a way that the driving element is moved up and down synchronically with the external rod;

e) an actuating element positioned within the engaging element for accommodating the driving element, the engaging element being driven in a single direction when the actuating element is rotated by the driving element;

f) a disc body secured to the bottom thereof and having mop yarns;

g) a locking mechanism mounted on the external rod for locking the internal rod and the external rod in place or for unlocking them in a telescopic state, wherein the actuating element is rotated by a linear motion of the driving element when the external rod is moved up-and-down; moreover, the engaging element is driven in rotation in a single direction, thereby creating a continuous rotation of the internal rod and the disc body in the same direction by the inertia force; as a result, a centrifugal force is produced to throw away the water absorbed in the mop yarns.

According to the invention, the driving element is constructed as a worm or a threaded piece. The actuating element receiving the driving element is constructed as a threaded sleeve such that the driving element drives the actuating element in rotation when the driving element is linearly moved up-and-down.

According to the invention, the engaging element is positioned at the top of the internal rod and fixed by an annular element and a fixing cap in place, and wherein the engaging element includes a plurality of upward engaging teeth at the internal rim of the bottom of thereof while the bottom of the actuating element is provided with downward engaging teeth corresponding thereto such that the rotation of the actuating element may cause a one-way rotation of the engaging element.

According to the invention, the upper portion of the engaging element is externally provided with a flange while the internal rim thereof includes an annular groove, and wherein the fixing cap includes a projecting rib at the external rim thereof such that the projecting rib can fit into the annular groove of the engaging element in place.

According to the invention, the locking mechanism includes: a) a clamping sleeve fastened at the bottom of the external rod, the lower portion thereof having an indentation, an inclined groove being formed at the periphery thereof; and b) a rotating sleeve mounted on the clamping sleeve with a projecting portion corresponding to the inclined groove of the clamping sleeve for moving up-and-down within the inclined groove. Accordingly, the clamping sleeve may be tightened or loosened by the rotating sleeve. Due to the action of the indentation, the locking of the internal rod and the external rod may be locked by the clamping sleeve in place for cleaning the floor, or the internal rod may be driven in a rotary state for dewatering the mop yarns.

According to the invention, the internal top portion of the clamping sleeve is provided with a plurality of locking hooks spaced apart from each other, and wherein the external rod includes corresponding holes into which the locking hooks fit, and wherein, when the external rod is pulled upward to a certain height, the locking hooks may be hooked on the fixing cap within the internal rod in place.

According to the invention, the disc body includes a dewatering basket rotatable within a bucket body, and wherein the dewatering basket may be synchronically driven in rotation when the disc body is rotated by the internal rod; in this way, the mop yarns of the disc body are subject to the centrifugal force for dewatering, and, the water removed may be received within the bucket body.

BRIEF DESCRIPTION OF THE DRAWINGS

The accomplishment of this and other objects of the invention will become apparent from the following descriptions and its accompanying figures of which.

DETAILED DESCRIPTION OF THE PREFERRED EMBODIMENT

Figure 1:
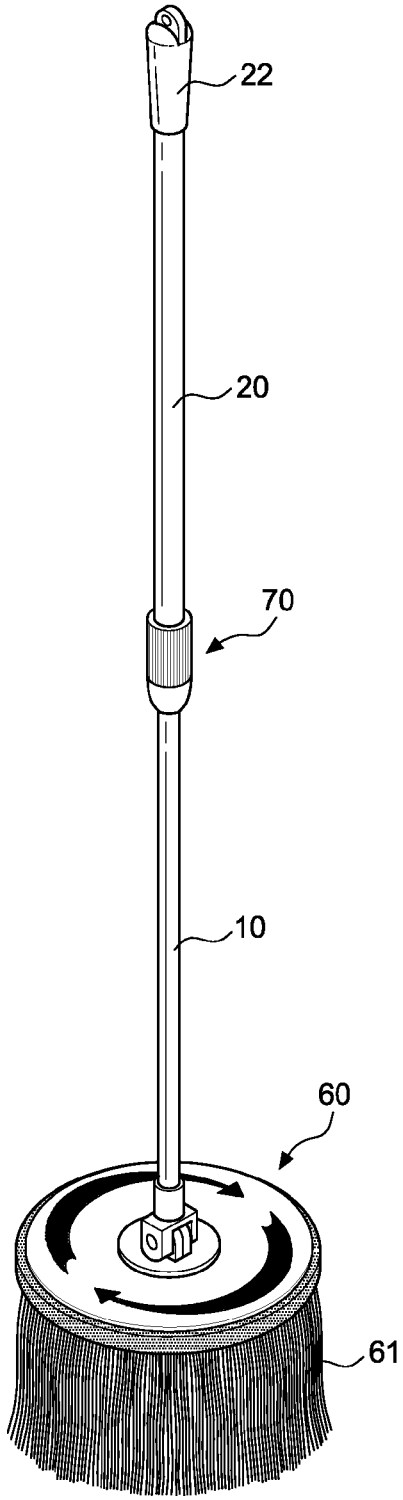
FIG. 1 is a perspective view of the invention.
Figure 2:
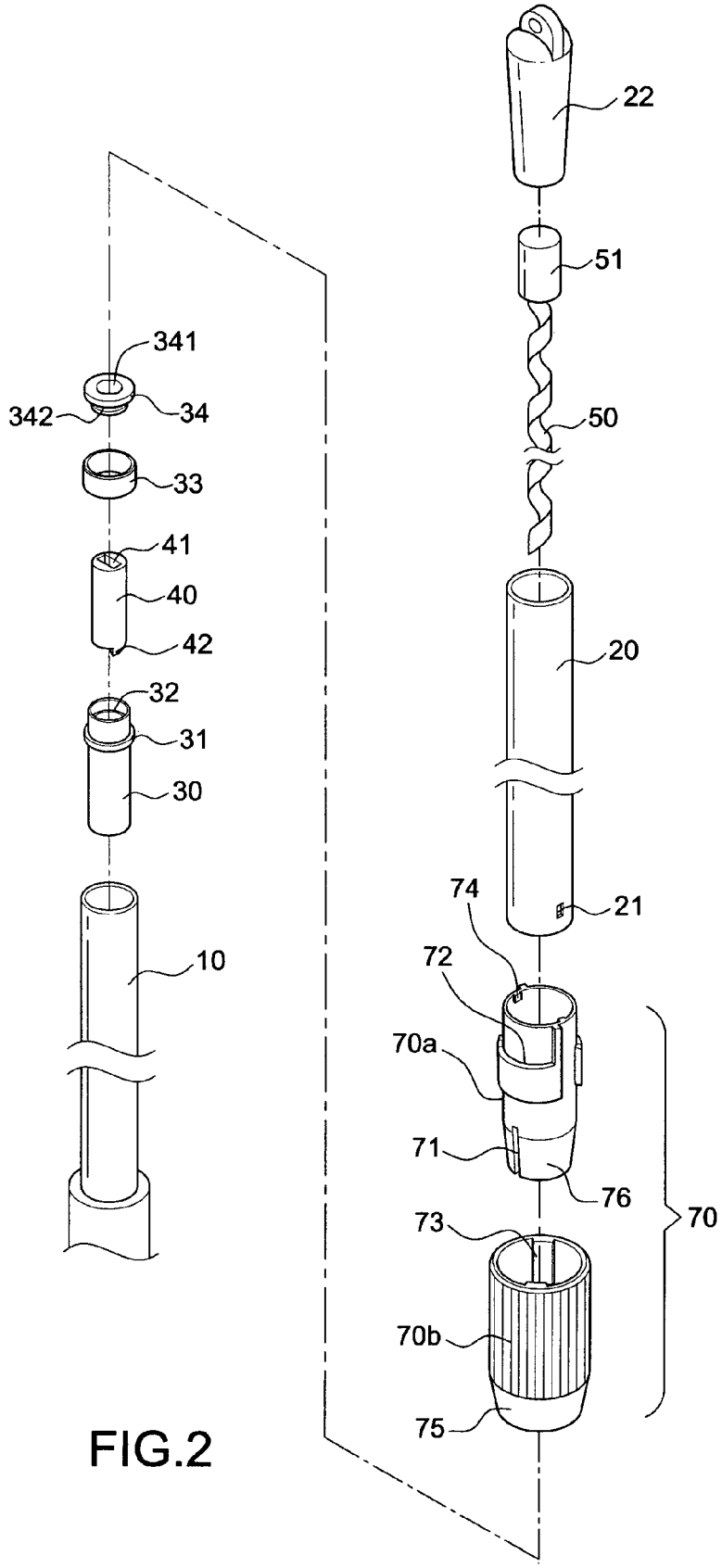
FIG. 2 is an exploded perspective view of the invention.
Figure 3:
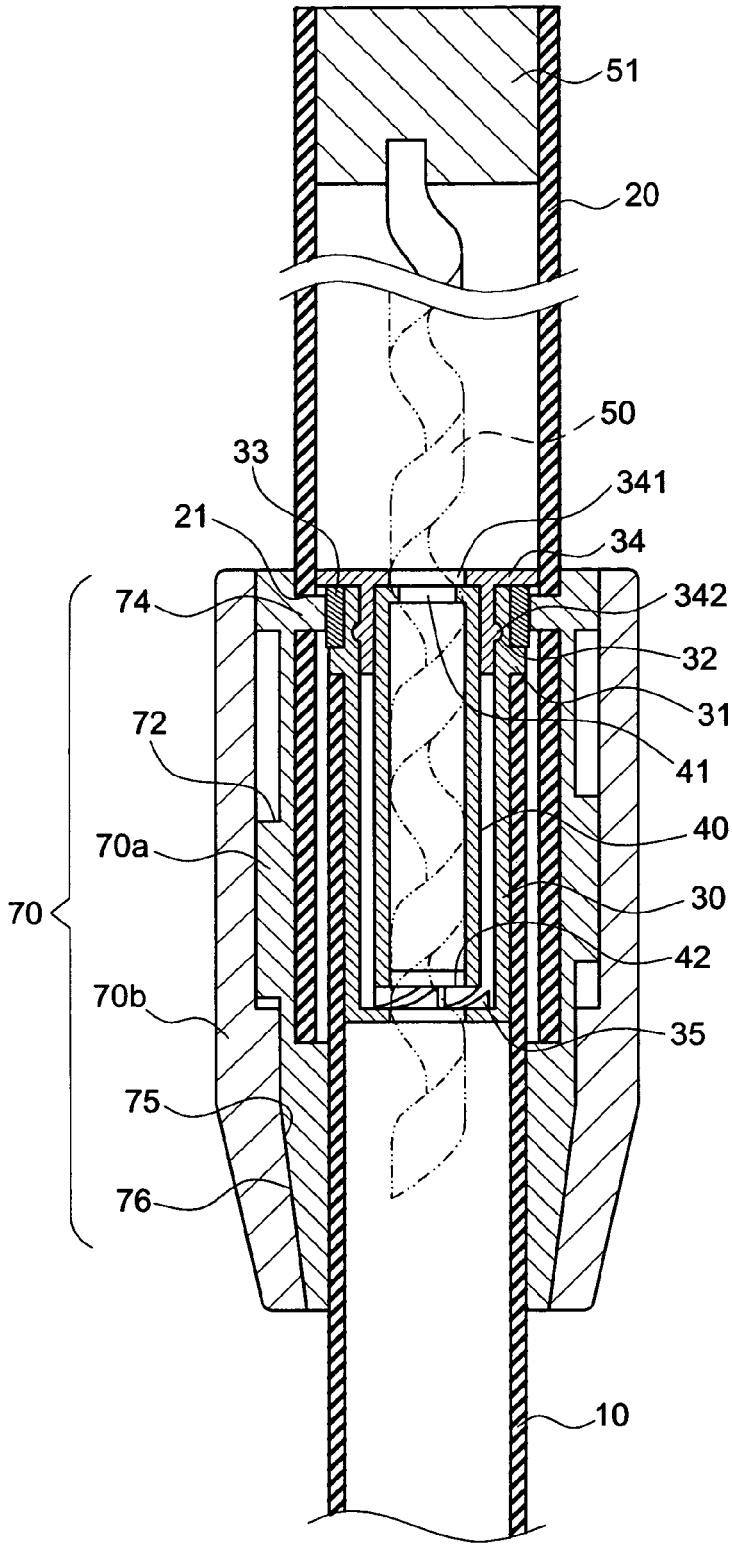
FIG. 3 is a cross-sectional view of the primary structure of the invention with the locking mechanism in a locked state.

First of all, referring to FIGS. 1 through 3, a mop in accordance with the invention includes an internal rod 10, an external rod 20, an engaging element 30, a driving element 50, an actuating element 40, a disc body 60, and a locking mechanism 70.

The internal rod 10 is constructed as a hollow circular tube and made by metal or non-metal material. Therefore, it can be an aluminum tube or a plastic tube.

The external rod 20 includes a bottom portion in a telescopic connection with a top portion of the internal rod 10. According to the embodiment, the operator can hold on the external rod 20 to conduct a telescopic motion on the internal rod 10.

Figure 6:
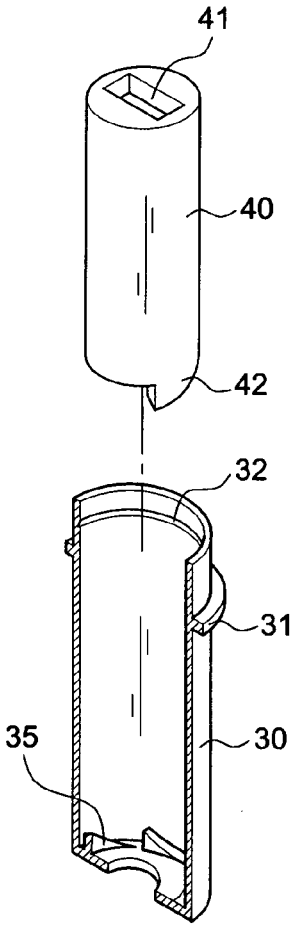
FIG. 6 is an exploded perspective view of the engaging element and the actuating element in accordance with the invention.

The engaging element 30 is positioned within the opening at the top of the internal rod 10. According to this embodiment, an annular element 33 and a fixing cap 34 are mounted and fixed on the engaging element 30 after the engaging element 30 is placed within the top of the internal rod 10. The upper portion of the engaging element 30 is externally provided with a flange 31 while the internal rim thereof includes an annular groove 32. The fixing cap 34 includes a through hole 341 at the top thereof and a projecting rib 342 at the external rim thereof. The projecting rib 342 can fit into the annular groove 32 of the engaging element 30 in place. As shown in FIG. 6, the engaging element 30 further includes a plurality of upward engaging teeth 35 at the internal rim of the bottom of thereof.

The driving element 50 is formed in an elongated shape and positioned within the external rod 20 in such a way that the driving element 50 is moved up and down synchronically with the external rod 20. According this embodiment, the driving element 50 includes a fixing block 51 fastened by a fixing element (not shown) or in a riveting way within the top end of the external rod 20. Moreover, as shown in FIG. 1, a protection sleeve 22 is mounted on the external rod 20.

Figure 7:
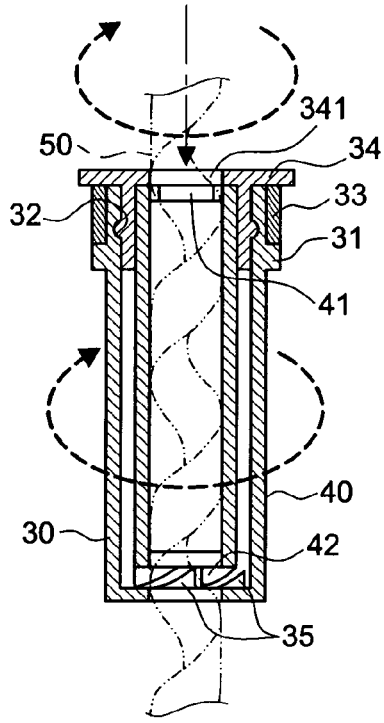
FIG. 7 is a cutaway view of the actuating element of the invention in driving the engaging element in rotation.
Figure 8:
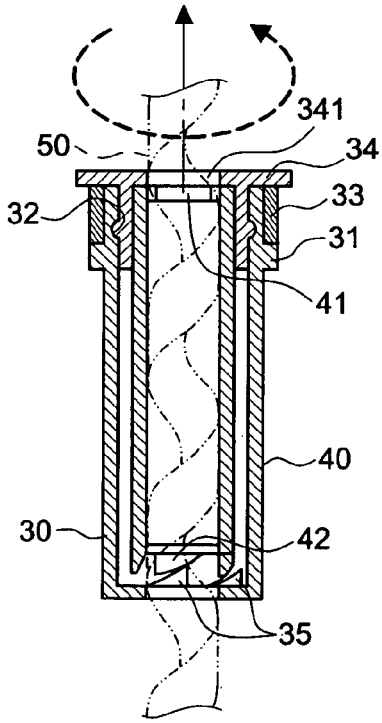
FIG. 8 is a cutaway view of the idle state of the actuating element of the invention relative to the engaging element.

The actuating element 40 is positioned within the engaging element 30 for accommodating the driving element 50. The driving element 50 is constructed as a worm or a threaded piece. As a result, the internal wall of the actuating element 40 has to be formed to be a threaded sleeve 41. According to the structure of the worm or the threaded piece, the actuating element 40 is correspondingly provided with a worm thread or an elongated groove such that the driving element 50 may impart a rotary motion to the actuating element 40 by means of the up-and-down linear movement of the external rod 20. According to this embodiment, the driving element 50 is constructed as a threaded piece. As a result, the threaded sleeve 41 at the internal end of the actuating element 40 is constructed as an elongated groove such that the up-and-down movement of the driving element 50 in the threaded sleeve 41 may impart a rotary motion to the actuating element 40 within the engaging element 30. As shown in FIG. 6, the bottom of the actuating element 40 is provided with downward engaging teeth 42 in contact with the upward engaging teeth 35 of the engaging element 30. Since the engaging teeth are formed in an inclined way, the drive is subject to a rotation in a certain direction. As shown in FIG. 7, the engaging element 30 is subject to a clockwise rotation like the actuating element 40 when the actuating element 40 is driven by the driving element 50. In this way, the actuating element 40 is driven when the driving element 50 is compressed downward. Meanwhile, the engaging element 30 is brought in clockwise rotation. To the contrary, as shown in FIG. 8, when the driving element 50 is pulled upward, the actuating element 40 is brought in a counterclockwise rotation. At that time, the downward engaging teeth 42 of the actuating element 40 is driven in an idle non-rotation state relative to the engaging teeth 35 of the engaging element 30. In other words, the engaging element 30 remains unmoved such that the driving element 50 can be returned to the original position for a renewed downward compression to drive the engaging element 30 again. The engaging element 30 and the actuating element 40 are the one-way drive mechanism and have a function similar to a one-way bearing. Thus, the one-way drive in accordance with the invention is not limited to the use of the engaging teeth. Another equivalent ways are also applicable.

The disc body 60 is secured to the bottom thereof and includes mop yarns 61.

Figure 4:
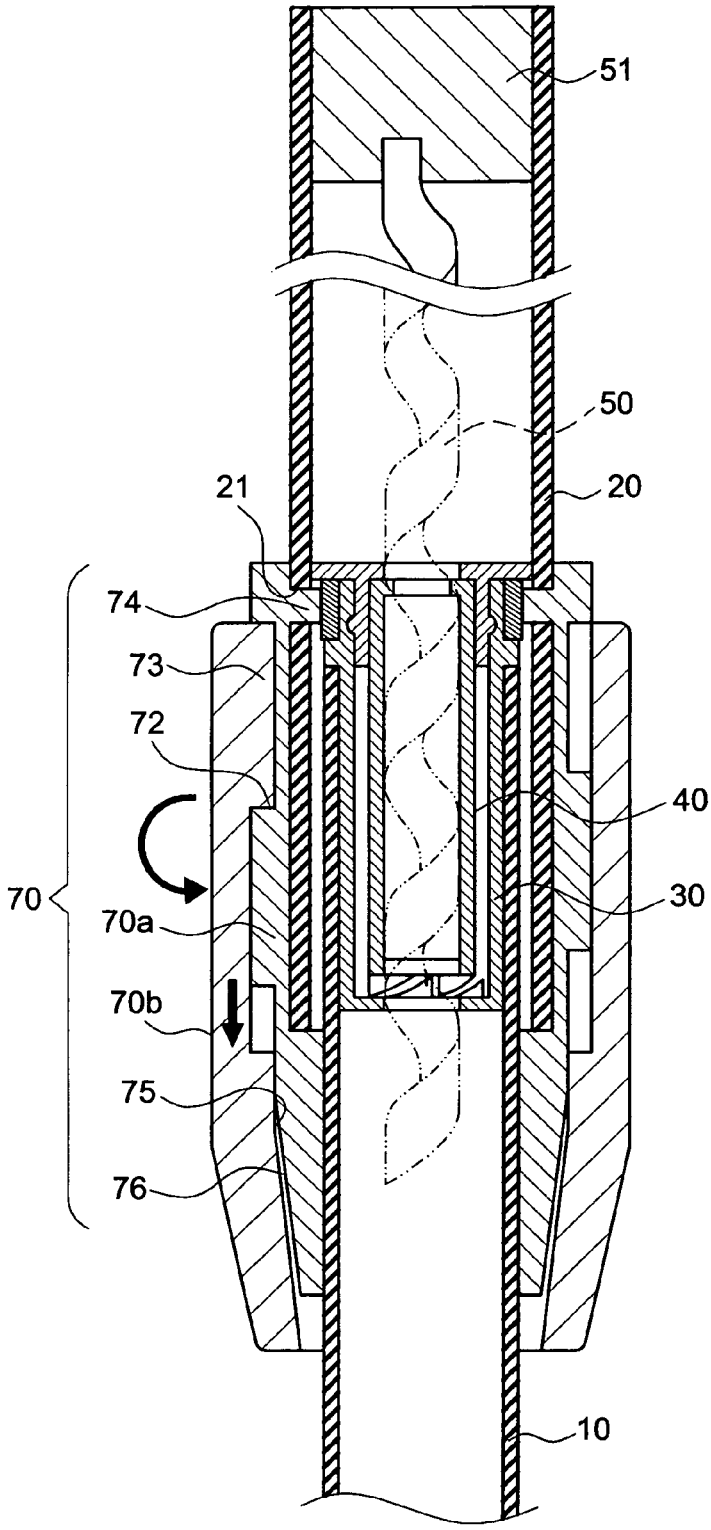
FIG. 4 is a cross-sectional view of the primary structure of the invention with the locking mechanism in an unlocked state.

The locking mechanism 70 is mounted on the external rod 20 for locking the internal rod 10 and the external rod 20 in place or for unlocking them in a telescopic state. As shown in FIGS. 2 through 4, the locking mechanism 70 includes, but should not be limited thereto: a clamping sleeve 70a fastened at the bottom of the external rod 20, the lower portion thereof having an indentation 71, an inclined groove 72 being formed at the periphery thereof; and a rotating sleeve 70b mounted on the clamping sleeve 70a with a projecting portion 73 corresponding to the inclined groove 72 of the clamping sleeve 70a for moving up-and-down within the inclined groove 72. In this way, the clamping sleeve 70a may be tightened or loosened by the rotating sleeve 70b. Due to the action of the indentation 71, the locking the internal rod 10 and the external rod 20 may be locked by the clamping sleeve 70a in place for cleaning the floor, or the internal rod 10 may be driven in a rotary state for dewatering the mop yarns 61. Moreover, the internal top portion of the clamping sleeve 70a is provided with a plurality of locking hooks 74 spaced apart from each other. The external rod 20 includes corresponding holes 21 into which the locking hooks 74 fit. When the external rod 20 is pulled upward to a certain height, the locking hooks 74 may be hooked on the fixing cap 34 within the internal rod 10 in place.

By use of the above-mentioned locking mechanism 70, as shown in FIG. 3, the rotating sleeve 70*b* is located at an upper place and employs an internal conic wall 75 at the bottom thereof for clamping an external conic wall 76 of the clamping sleeve 70*a* such that the internal rod 10 is clamped by the clamping sleeve 70*a* in place. As a result, it is not possible to move the external rod 20 downward, thereby creating a locked state of the locking mechanism 70.

In unlocking the locking mechanism 70, as shown in FIG. 4, the rotating sleeve 70b has to be rotated at a certain angle to move the projecting portion 73 downward along the inclined groove 72, thereby detaching the internal conic wall 75 of the rotating sleeve 70b from the external conic wall 76 of the clamping sleeve 70a. In this way, the internal rod 10 is no longer clamped by the clamping sleeve 70a. Thus, the external rod 20 may be linearly moved relative to the internal rod 10.

Figure 5:
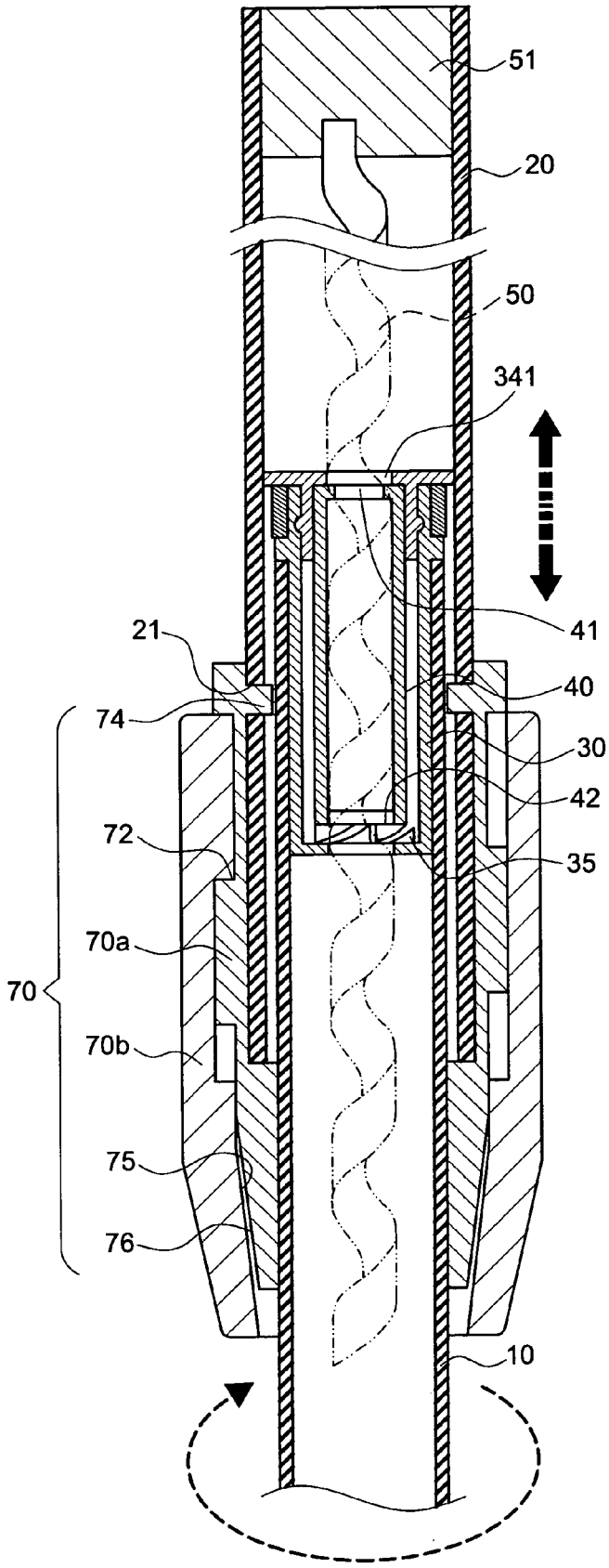
FIG. 5 is a cross-sectional view of the primary structure of the invention with the internal and external rods in a relative motion state.

As shown in FIG. 5, when the external rod 20 is compressed downward, the driving element 50 is synchronically lowered to pass through the threaded sleeve 41 of the actuating element 40. The clockwise rotation of the actuating element 40 may lead to a synchronically rotation of the engaging element 30. The engaging element 30 is tightly secured to the internal rod 10. Therefore, the internal rod 10 may be rotated in a single direction. When the external rod 20 is pulled upward, as depicted above, the actuating element 40 is in an idle state relative to the engaging element 30 when rotated counterclockwise. In this way, the internal rod 10 is subject to a continuous rotation in a clockwise direction due to the inertia force without being affected by the upward pull of the external rod 20.

Figure 9:
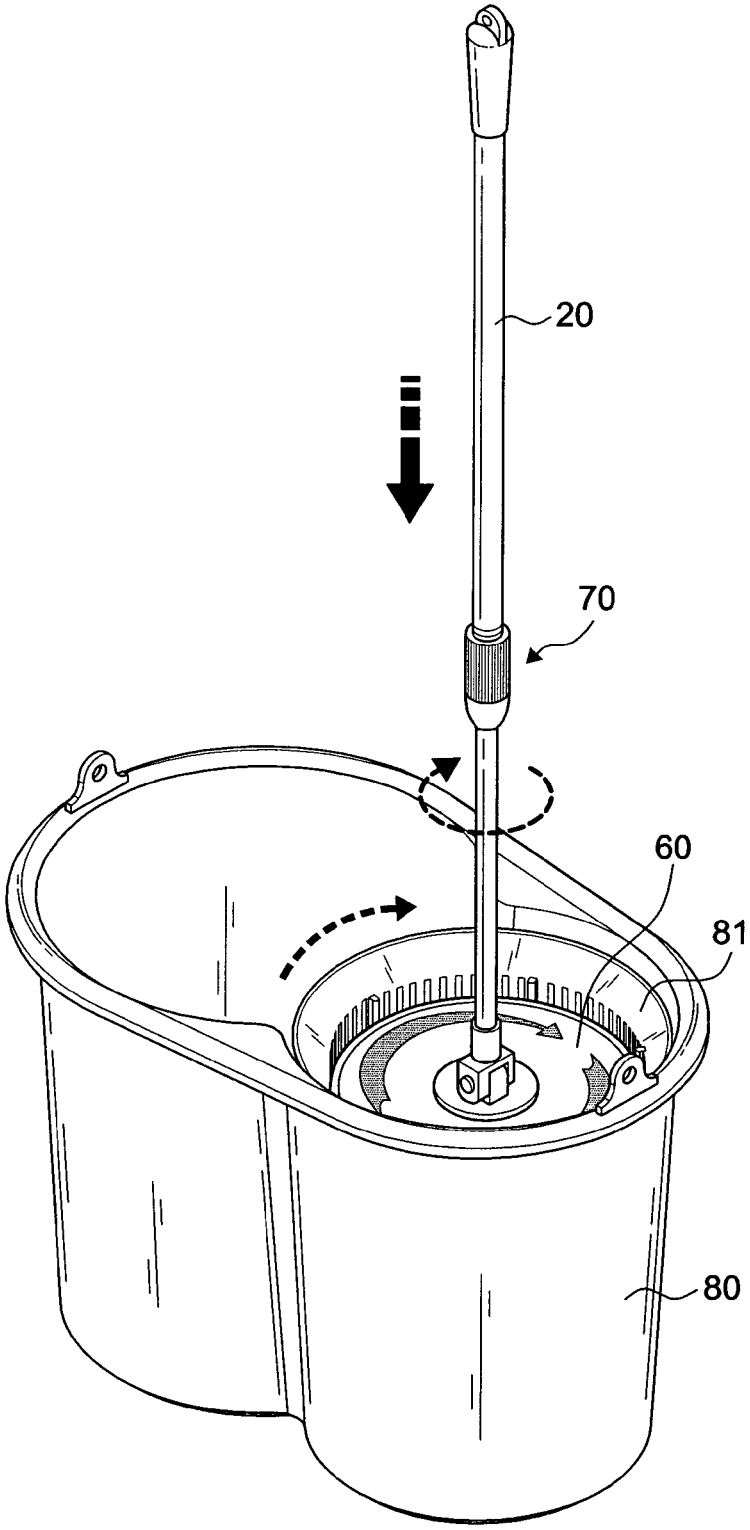
FIG. 9 is an application view I of the invention.

As shown in FIG. 9, when the external rod 20 is pushed downward, the internal rod 10 and the disc body 60 are rotated in a single direction, thereby removing the mop yarns 61 (see FIG. 1) attached to the disc body 60 by the centrifugal force outward.

Figure 10:
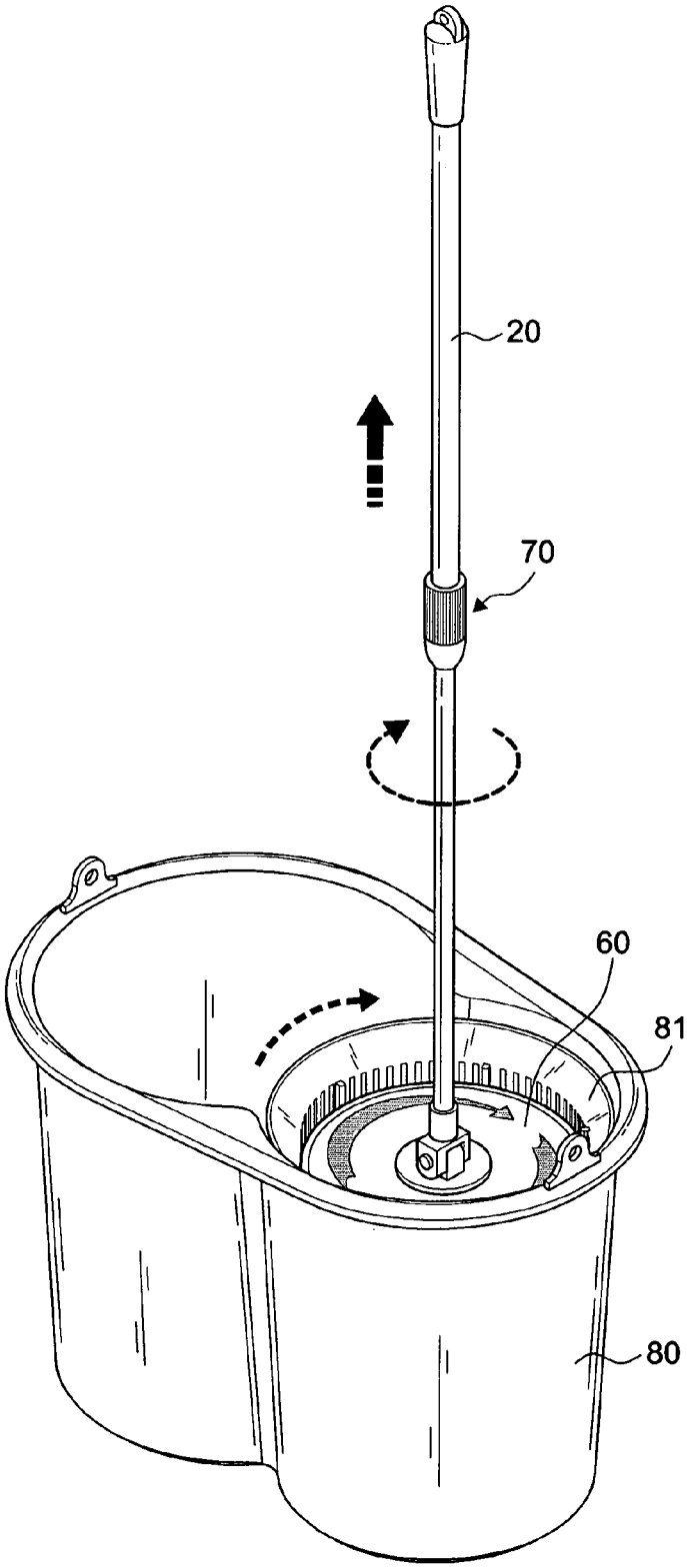
FIG. 10 is an application view II of the invention.

Furthermore, as shown in FIG. 10, when the external rod 20 is pulled upward, as depicted above, the internal rod 10 won't be acted upon thereby and remains to rotate in the same direction due to the action of the inertia force. In this way, the internal rod 10 and the disc body 60 may be rotated more than 10 times within a dewatering basket 81 of a bucket body 80 by means that the user pushes downward and pulls upward the external rod 20 for a few times. Unlike the conventional bucket body 80 employing an internal drive mechanism to drive its dewatering basket 81 in rotation by a user's foot, the dewatering basket 81 according to this embodiment is rotatable within the bucket body 80. Unlike the conventional way, the dewatering basket 81 in accordance with the invention may be synchronically driven in rotation when the disc body 60 is rotated by the internal rod 10. In this way, the mop yarns 61 of the disc body 60 are subject to the centrifugal force for dewatering. Meanwhile, the water removed may be received within the bucket body 80.

According to the above-mentioned structure of the invention, a practical and ergonomic use is achieved. A foot-operation is no more required so that the user won't fall over himself due to an unstable center of gravity. Moreover, the driving elements for foot operation are no longer required, thereby reducing the cost considerably. As a result, the mop in accordance with the invention ensures a practical and safe use.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A mop with the function of dewatering mop yarns by twisting in a single direction via an up-and-down linear motion, comprising:

a) an internal rod;

b) an external rod having a bottom portion in a telescopic connection with a top portion of the internal rod;

c) an engaging element positioned within the opening at the top of the internal rod;

d) a driving element formed in an elongated shape and positioned within the external rod in such a way that the driving element is moved up and down synchronically with the external rod;

e) an actuating element positioned within the engaging element for accommodating the driving element, the engaging element being driven in a single direction when the actuating element is rotated by the driving element;

f) a disc body secured to the bottom thereof and having the mop yarns secured to the disc body;

g) a locking mechanism mounted on the external rod for locking the internal rod and the external rod in place or for unlocking them in a telescopic state, wherein the actuating element is rotated by a linear motion of the driving element when the external rod is moved up-and-down; moreover, the engaging element is driven in rotation in a single direction, thereby creating a continuous rotation of the internal rod and the disc body in the same direction by the inertia force; as a result, a centrifugal force is produced to throw away the water absorbed in the mop yarns; and the disc body cooperates with a dewatering basket rotatable within a bucket body, and wherein the dewatering basket is synchronically driven in rotation when the disc body is rotated by the internal rod; the mop yarns of the disc body are subject to the centrifugal force for dewatering, and the water removed is received within the bucket body.

2. The mop with the function of dewatering the mop yarns by twisting in a single direction via an up-and-down linear motion as recited in claim 1 wherein the driving element is constructed as a threaded piece, and wherein the actuating element receiving the driving element is constructed as a threaded sleeve such that the driving element drives the actuating element in rotation when the driving element is linearly moved up-and-down.

3. The mop with the function of dewatering the yarns by twisting in a single direction via an up-and-down linear motion as recited in claim 1 wherein the engaging element is positioned at the top of the internal rod and fixed by an annular element and a fixing cap in place, and wherein the engaging element includes a plurality of upward engaging teeth at the internal rim of the bottom of the engaging element while the bottom of the actuating element is provided with downward engaging teeth corresponding thereto such that the rotation of the actuating element may cause a one-way rotation of the engaging element.

4. The mop with the function of dewatering the mop yarns by twisting in a single direction via an up-and-down linear motion as recited in claim 3 wherein the upper portion of the engaging element is externally provided with a flange while the internal rim thereof includes an annular groove, and wherein the fixing cap includes a projecting rib at the external rim thereof such that the projecting rib can fit into the annular groove of the engaging element in place.

5. The mop with the function of dewatering the mop yarns by twisting in a single direction via an up-and-down linear motion as recited in claim 1 wherein the locking mechanism includes:

a) a clamping sleeve fastened at the bottom of the external rod, the lower portion thereof having an indentation, an inclined groove being formed at the periphery thereof; and b) a rotating sleeve mounted on the clamping sleeve with a projecting portion corresponding to the inclined groove of the clamping sleeve for moving up-and-down within the inclined groove, whereby the clamping sleeve may be tightened or loosened by the rotating sleeve, and due to the action of the indentation, the locking the internal rod and the external rod may be locked by the clamping sleeve in place for cleaning the floor, or the internal rod may be driven in a rotary state for dewatering the mop yarns.

6. The mop with the function of dewatering the mop yarns by twisting in a single direction via an up-and-down linear motion as recited in claim 5 wherein an internal top portion of the clamping sleeve is provided with a plurality of locking hooks spaced apart from each other, and wherein the external rod includes corresponding holes into which the locking hooks fit, and wherein, when the external rod is pulled upward to a certain height, the locking hooks may be hooked on the fixing cap within the internal rod in place.

* * * * *